United States Patent [19]

McHale et al.

[11] Patent Number: 4,938,344

[45] Date of Patent: Jul. 3, 1990

[54] COLLAPSIBLE DISPLAY APPARATUS

[75] Inventors: Patricia M. McHale, Kernersville; Jeffrey T. Weber, Winston-Salem, both of N.C.

[73] Assignee: Nabisco Brands, Inc., East Hanover, N.J.

[21] Appl. No.: 257,601

[22] Filed: Oct. 14, 1988

[51] Int. Cl.[5] ..... B65D 5/52

[52] U.S. Cl. ..... 206/45.25; 206/461; 206/223

[58] Field of Search ..... 206/45.24, 45.25, 466, 206/44 R, 461, 575, 223

[56] References Cited

U.S. PATENT DOCUMENTS

| | | | |
|---|---|---|---|
| 990,918 | 5/1911 | Stadler . | |
| 1,473,390 | 11/1923 | Stranders . | |
| 1,775,618 | 9/1930 | Kubler | 206/45.25 |
| 2,120,519 | 6/1938 | Friedman et al. . | |
| 2,716,485 | 8/1955 | Hecker | 206/45.25 |
| 2,929,498 | 3/1960 | McCormick . | |
| 2,949,185 | 8/1960 | Foote et al. | 206/45.24 |
| 3,061,092 | 10/1962 | Hime et al. . | |
| 3,407,928 | 10/1968 | Watt, Jr. | 206/45.24 |
| 3,557,945 | 1/1971 | Gourio | 206/45.24 |
| 3,685,649 | 8/1972 | Diehl | 206/45.24 |
| 3,964,606 | 6/1976 | Hogg et al. . | |
| 4,054,242 | 10/1977 | Strobe . | |
| 4,669,610 | 6/1987 | Lindsey et al. | 206/45.24 |
| 4,781,289 | 11/1988 | Perkins | 206/45.24 |

FOREIGN PATENT DOCUMENTS

| | | | |
|---|---|---|---|
| 303117 | 7/1952 | Sweden | 206/45.24 |

*Primary Examiner*—Joseph Man-Fu Moy

[57] ABSTRACT

A display device such as a greeting card having a two-layered construction wherein a single sheet of a fibrous material such as cardboard is folded back over itself to form front and back layers. The front layer is printed with a message to be displayed and is provided with a cut-out window area which supports and displayed a packaged object such as rolled candy. The back layer is provided with a series of transverse perforations or fold lines so that a "pop-up" support area may be formed to allow the device to stand freely on its own. The support area defines a space located behind and of the same length as the window area to accommodate the package of candy.

5 Claims, 5 Drawing Sheets

COLLAPSIBLE DISPLAY APPARATUS

BACKGROUND OF THE INVENTION

1. Field of the Invention

The present invention relates to advertising and display devices, and more particularly, to collapsible greeting cards for displaying objects such as candy in a cutout portion of the card, as well as a kit having a plurality of such cards and candy connected to each other and packaged together.

Collapsible advertising and display devices in the form of greeting cards or posters are well known in the art. These cards have so-called "pop-up" sections which either display a figure or character and involve a series of manipulations to position the figure properly. Other display cards provide a series of separation lines for engaging various sections of the cards to create a storage cavity. In most cases, the manipulations are required to provide overlapping layers of the card material at various locations for strength and support.

2. Discussion of the Prior Art

In the prior art, various display and advertising devices comprising card-like forms are disclosed, whereby "pop-up" type sections are provided to display figures or to provide storage cavities through a series of manipulations of the various components or walls of the sections. These display devices, however, are subject to several disadvantages, which in many cases affect the integrity and strength of the device, and which consequently inconvenience the purchaser or user. If the sections are not properly manipulated and located, the display device will be damaged and thus its utility will be reduced.

McCormack, et al., U.S. Pat. No. 2,929,498, discloses a packing and display device for rolled materials such as tape rolls. The device comprises a single sheet of cardboard or like material which is stamped or cut so that the cut lines may be separated while the cardboard is folded and shaped. The folds result in a horizontal projection perpendicular to the vertical cardboard sheet, which remains vertical for display purposes and the projection serves to support the tape roll by fitting the roll over the projection. McCormack, et al.'s device requires a series of manipulations in which various parts of the display device must be folded and moved to produce the finished display. In addition, there is no means provided for securing the parts of the device together, so that if there are no rolls of tape on the display, the display will fall apart unless secured to a second display or mounting board.

Stadler, U.S. Pat. No. 990,918, discloses an advertising device in the form of a card in which a "pop-up" figure or construction is provided on the device. The figure or construction is folded into a flattened condition and remains under tension inside an envelope, so that when the card is removed from the envelope the construction "pops-up" into display position. This device suffers the disadvantage that several elements must be simultaneously folded, under spring-tension, and includes portions which must be secured at various points along the base card. Improper folding reduces the utility of the device, and it is apparent that re-use will limit the integrity of the device.

Stranders, U.S. Pat. No. 1,473,390, discloses a collapsible display device which folds inward upon itself so that its outer edges meet in the closed position, and opens to form a tiered or layered structure. This device comprises a plurality of interlocking wall members which must be precisely folded to enable the device to work properly.

Hogg, et al. U.S. Pat. No. 3,964,606, discloses a package, display, and dispensing device for rolled or spooled material such a rope or thread. The device comprises a single sheet of cardboard or like material folded back over itself to form a two-layer structure. The front layer is provided with a window to reveal the spool, which is fit into the window from behind prior to folding over the back layer. The cardboard is cut so that upon positioning the layers together a pocket is formed to accommodate the spool, with side flaps closing off the pocket. Hogg, et al. suffers the disadvantage that the package is bulky and the spool is non-removable without destroying the device. In addition, the cardboard must be cut precisely to ensure access to the spool and to prevent excessive tension on the spool which would limit spinning of the spool and reduce the effectiveness of the device as a dispenser.

The novel display device of the present invention obviates the disadvantages of the prior art and provides a collapsible display of the greeting card type which supports and displays a packaged object such as rolled candy while being self-supporting and free-standing. The device may be re-used without reduction of integrity since perforated fold lines are provided in the structure, which is preferably made of cardboard or like material. The fold lines are conventional and may include perforations, indentations, scored lines, and the like. However, when perforations are used, the perforations are spaced a sufficient distance apart so as not to weaken the strength of the fibrous material during folding. The structure of the device preferably consists of a single polygonally-shaped sheet of cardboard, in a form such as a rectangle or the like, folded back over itself and secured at least one transverse location so that the back layer may be moved relative to the front layer to define a space from wall members forming the space, for supporting the device in a free-standing manner. A window or cutout area is provided on the front layer for easy insertion and removal of the packaged object and may comprise a foldable flap which may be pushed in the direction of the back layer and into the space defined by back layer when it is moved relative to and away from the front layer.

SUMMARY OF THE INVENTION

The present invention eliminates or substantially ameliorates the disadvantages encountered in the prior art through the provision of an easy to assemble greeting card type display device which supports and displays a packaged object such as rolled candy or the like.

A collapsible display device is provided, in which the device is preferably constructed of a single rectangular sheet of a fibrous material such as cardboard or similar material. The cardboard material is folded back over itself to form a two-layered structure, at a fold line which is one of a series of transverse fold lines provided on the back layer of the two-layered structure. The fold lines may be perforations, indentations, scored lines, or the like, which allow for bending of the cardboard material along a definitive line but serves to prevent breaking or tearing. When perforations are provided, the perforations are spaced a sufficient distance apart so as to reduce the risk of tearing or separation. The fold lines are preferably positioned parallel to a width edge of the rectangular device, and are parallel to each other. Of course, if desired, the fold lines may be positioned parallel to a length edge of the device, as well as to each other.

The front layer is provided with a polygonally-shaped window area, formed as a rectangle, circle, square, triangle, or the like which accommodates the rolled package to support and display the package, and the window may be a cutout area or comprise a flap which is to be folded inward towards the back layer. The back layer is secured to the front layer at least one location, and the transverse fold lines allow the back layer to be moved away from the front layer, which in effect, "pops-up" the back layer, thereby creating an enclosed space behind the front layer. The space is preferably as wide as the length of the window, such that the window is enclosed by the wall members of the "pop-up" portion of the back layer.

The "pop-up" portion of the back layer serves the additional purpose of supporting the display device by acting as a support stand to allow the device to stand freely on its own. Since the back layer has the fold lines extending the entire width of the cardboard sheet, when the back layer is folded to form the "pop-up" section, the "pop-up" section serves as a stand to enable the device to stand on its own.

Furthermore, the depth of the "pop-up" section is such that the package of candy can be pushed into the window only a predetermined distance, which ensures easy removal, especially for children. This predetermined depth of the section behind the window avoids the problems associated with inserting the package too far, which would require destruction of the display device to remove the package thereby preventing.

The present invention further comprises a kit wherein a plurality of display cards are joined together in sheets and packaged along with an equal number of candy packages. The sheets of cards are joined together along separation lines, preferably perforation lines, where the points at which the cards are joined are spaced apart a distance sufficient to permit easy separation. The kit consists essentially of a box containing the sheets of cards, each sheet containing at least two, preferably four, cards joined together by the separable perforations. The box also contains the candy packages, which may be packed loosely or in a container such as a plastic bag. In use, the kit is opened to reveal the sheets of cards and the candy packages.

The cards and box are printed with characters and messages which may concern or denote a particular occasion, such as a holiday, birthday or the like. The sheets of cards are removed and separated along the separation lines and assembled in the manner described above. The candy packages, preferably in rolled form, are inserted into the window area of the individual cards, and an equal amount of candy rolls as the number of individual cards are provided, so the entire kit may be used.

Accordingly, it is an object of the present invention to provide a display device of the greeting card type which supports and displays an object such as a candy package.

It is a further object of the invention to provide a display device which has a two layer construction whereby the second layer may be moved relative to the first layer to create a stand to allow the device to support itself in a free-standing position.

It is yet another object of the invention to provide a display device for supporting and displaying a candy package which is collapsible and reusable.

A still further object of the invention is to provide a display device having a two layer construction formed from a single sheet of fibrous material, where the sheet is folded over itself to form the two layers.

An additional object of the present invention is to provide a kit containing a plurality of collapsible display devices separably attached to each other in sheet form, and an equal number candy packages such that after separation and assembly of the display devices, the candy may be displayed by the individual display devices.

BRIEF DESCRIPTION OF THE DRAWINGS

The foregoing objects and other features of the invention will become more readily apparent and may be understood by referring to the following detailed description of a preferred embodiment of the collapsible display device, taken in conjunction with the accompanying drawings, in which.

DETAILED DESCRIPTION OF THE PREFERRED EMBODIMENTS

Figure 1:
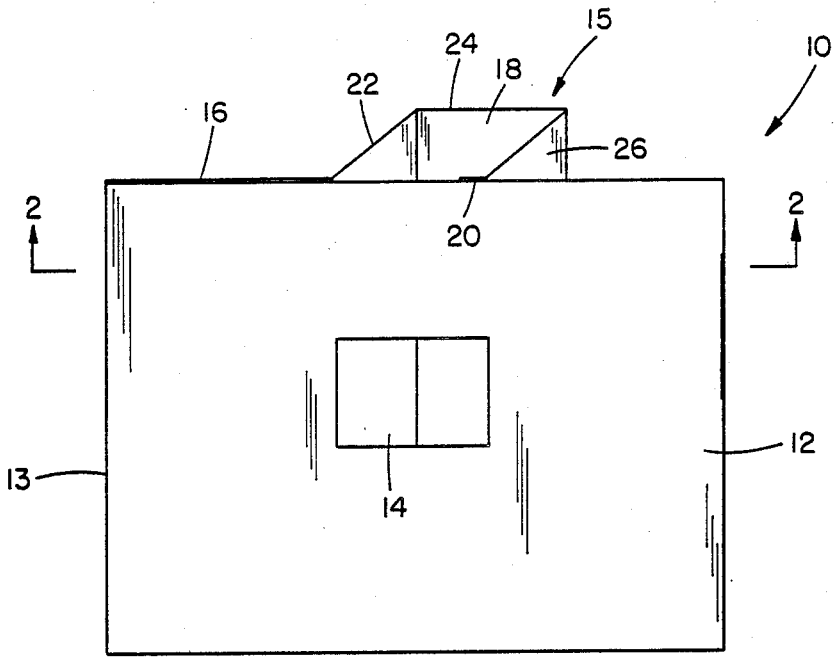
FIG. 1 illustrates an elevation of a preferred embodiment of the display device of the present invention showing the device in the assembled position.

Referring now in specific detail to the drawings, in which identical reference numerals identify similar or identical elements throughout the several views, FIG. 1 shows the preferred embodiment of the collapsible display device of the present invention. The display device 10 is constructed of a single sheet of a fibrous material, such as cardboard, and is folded over itself to form a two-layered construction as shown. The cardboard is of a thickness and weight sufficient to prevent bending or sagging of the device during use, and also provides a rigidity necessary to avoid inadvertent collapsing of the device when it is in the assembled position. An example of a cardboard that may be used is solid bleach sulfate (SBS) white board, and in one instance, testing has been conducted and satisfactory results have been achieved with a 12 point SBS cardboard. The device is preferably rectangular in shape, but may of course comprise other shapes if so desired. The front layer 12 is folded along fold line 13 and bends back around to form back layer 16. Fold line 13 is a perforated line, an indentation, or a scored line, which allows for easy folding without breaking or tearing. Preferably a perforation is provided, and the cuts forming the perforations are sufficiently spaced apart so as to allow for folding but not separation. The spacing of the perforations also provides for sufficient rigidity at the fold line to maintain the proper bending of the cardboard at the fold line. Front layer 12 is provided with a window 14, which may be a cut out, or semi-cut out area whereby a flap region is provided. Preferably, window 14 is a complete cut out area.

Figure 3:
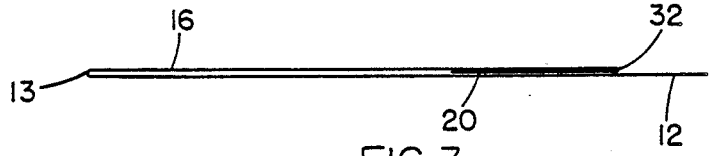
FIG. 3 illustrates a view similar to FIG. 2 but with the device in the unassembled position.

As best seen in FIG. 3, device 10 is collapsible and can be maintained as a flat two layer construction for bulk packing to point of sale locations. Back layer 16 folds back under itself at fold line 32 which is similar to fold line 13, and is secured to front layer 12 at least at tab 20 by glue or the like. Tab 20 is secured by a glue line or strip which extends across the width of the device, but preferably is interrupted along with tab 20 at window 14 so that fold line 34 extends along the edge of window 14, as does fold line 28.

Figure 2:
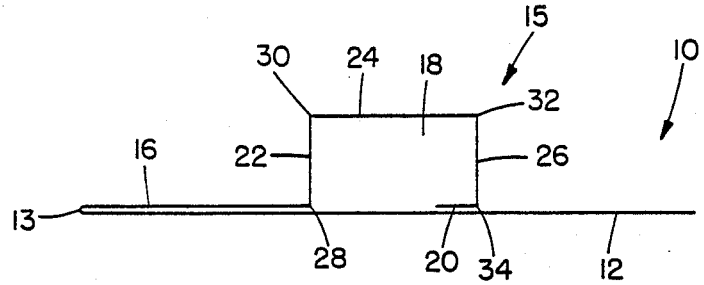
FIG. 2 illustrates a view of the device of FIG. 1 along lines 2—2.

In use, device 10 allows for movement of back layer 16 relative to front layer 12 to create a "pop-up" support area generally designated as 15. As best seen in FIG. 2, fold lines 28, 30, 32 and 34, similar to fold lines 13 and 32, are provided so that when support area 15 is moved away from front layer 12 a space 18 is formed and defined by wall members 22, 24 and 26. Wall members 22 and 26 are perpendicular to front layer 12 and extend outwardly along opposite edges of window 14, preferably the edges comprising the length sides of rectangular window 14. Support area 15 serves as a stand to allow device 10 to stand freely. Front layer 12 is preferably printed with a message or drawing so that support area 15 permits the device 10 to stand freely and thereby allows the message to be displayed or viewed.

Figure 7:
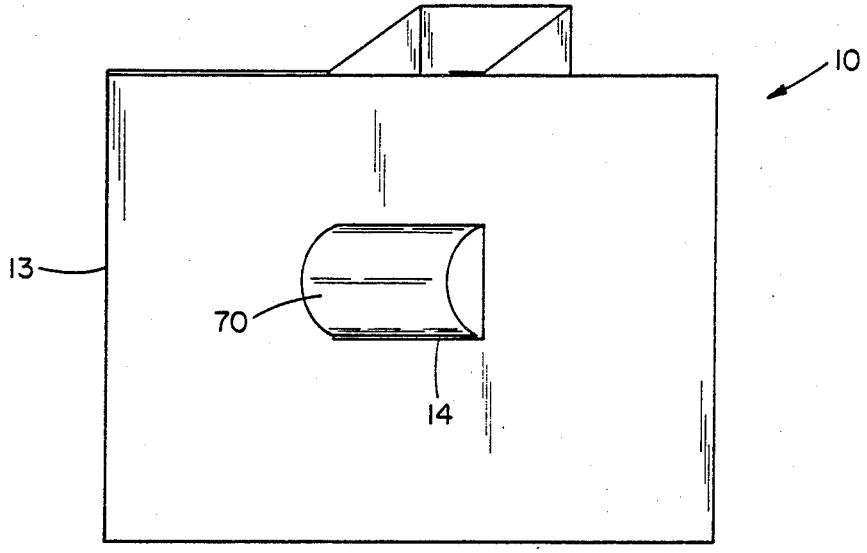
FIG. 7 illustrates an elevation of the device of FIG. 1 supporting and displaying a candy package.
Figure 8:
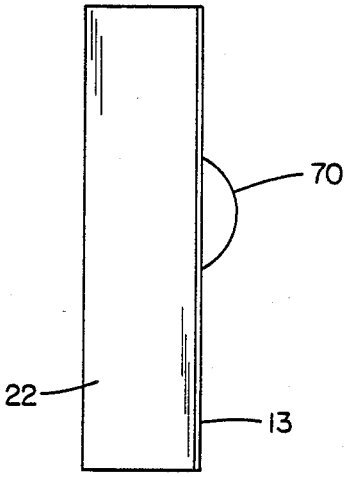
FIG. 8 illustrates a side elevation of the device of FIG. 7.

After support area 15 has been assembled, window 14 may accommodate a packaged object, such as a package or roll of candy or the like, by pushing the package into the window 14. As best seen in FIGS. 7 and 8, a package such as a roll of candy 70 may be inserted into window 14, which supports and displays the roll. Space 18, as defined by the wall members 22, 24 and 26, is as wide as the length of window 14, and preferably deep enough to accommodate at least one-third the diameter or width of the roll, depending on its shape, but not greater than three-quarters the diameter of the roll 70. The dimensions of window 14 are substantially similar to the height and length of roll 70, in order to ensure a snug fit, while allowing for easy removal of the roll so as not to destroy the integrity of the window 14. After removal of the roll 70, support area 15 may be collapsed for easy storage of the display device 10 prior to re-use.

Figure 4:
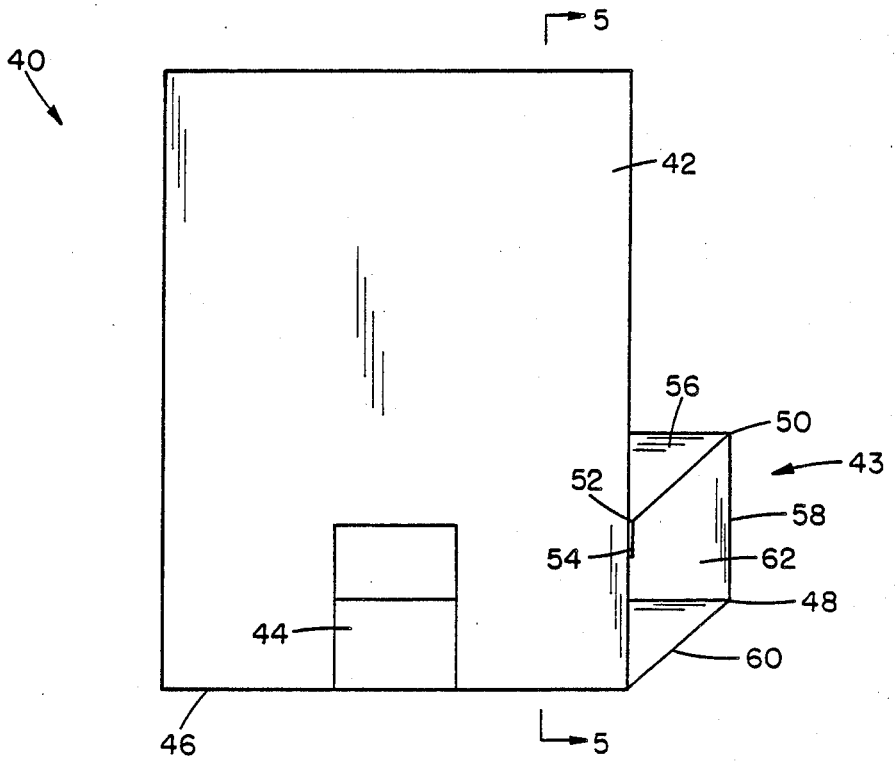
FIG. 4 illustrates an elevation of an alternate embodiment of the present invention in the assembled position.
Figure 5:
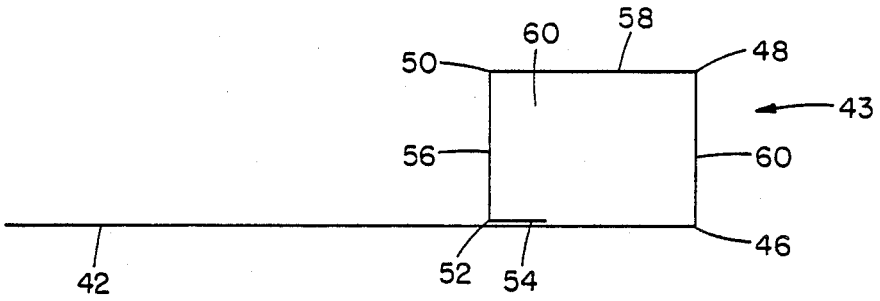
FIG. 5 illustrates a view of the device of FIG. 4 along lines 5—5.
Figure 6:
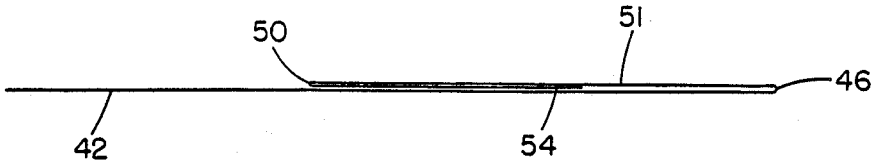
FIG. 6 illustrates a view similar to FIG. 5 but with the device in the unassembled position.

FIGS. 4, 5 and 6 show an alternate embodiment of the present invention in which support area 43 is located along edge 46 of display device 40. Edge 46 comprises a fold line similar to fold line 13 of FIG. 1 so that front layer 42 folds back over itself and is collapsible as seen in FIG. 6. Fold line 50, similar and parallel to edge 46, allows the back layer 51 to fold back under itself to be secured to front layer 42 at tab 54, preferably by glue or the like. Tab 54 is similar to tab 20 of FIG. 1. In order to assemble support area 43, back layer 51 is moved away from front layer 42 and folded at fold lines 46, 48, 50 and 52, thus forming support area 43 as defined by wall members 56, 58 and 60. A space 62 is formed by the wall members as best seen in FIG. 4. A window area 44 is provided in front layer 42 to accommodate a packaged object such as a package or roll of candy, which is inserted into window 44 to be supported and displayed in a manner similar to that described above regarding FIG. 7. Wall members 56 and 60 are perpendicular to front layer 42 and extend outward from the edges of window 44 which define the width of the rectangular window 44, in a manner similar to FIG. 1.

Figure 9:
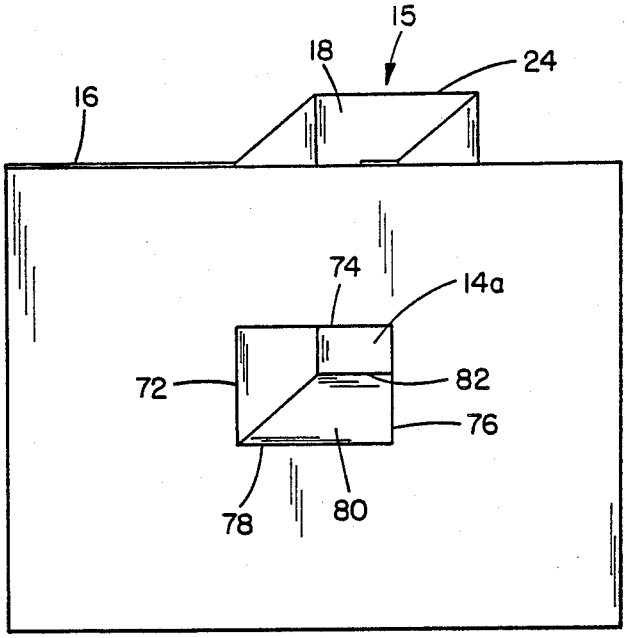
FIG. 9 illustrates the device of FIG. 1 having a foldable flap member on a front face of the device.

FIG. 9 illustrates an alternate embodiment of window 14 where a flap member 80 is provided. Window 14*a* is cut out from top layer 12 along cut or separation lines 72, 74 and 76, but edge 78 remains uncut. Edge 78 is a fold line similar to fold line 13, and may be perforated, indented or scored to provide for a neat and exact fold. Flap member 80 is in the same plane as front layer when device 10 is in the unassembled position. When back layer 16 is moved relative to and away from front layer 12 to form support area 15, flap member 80 is pushed towards back wall member 24 of support area 15, thereby folding flap member 80 inward along fold line or edge 78, such that top edge 82 of flap member 80 engages back wall member 24. Flap member 80 serves to provide additional support to the wall members of support area 15, and further prevents inadvertent collapsing of support area 15 by completely occupying space 18 and being in contact with the wall members of support area 15. Flap member 80 also allows for the support of loose objects, rather than packaged or rolled items such as candy, and also for the support of soft or irregularly shaped objects, which easily rest on the shelf formed by flap member 80 when it is in its folded position.

Figure 10:
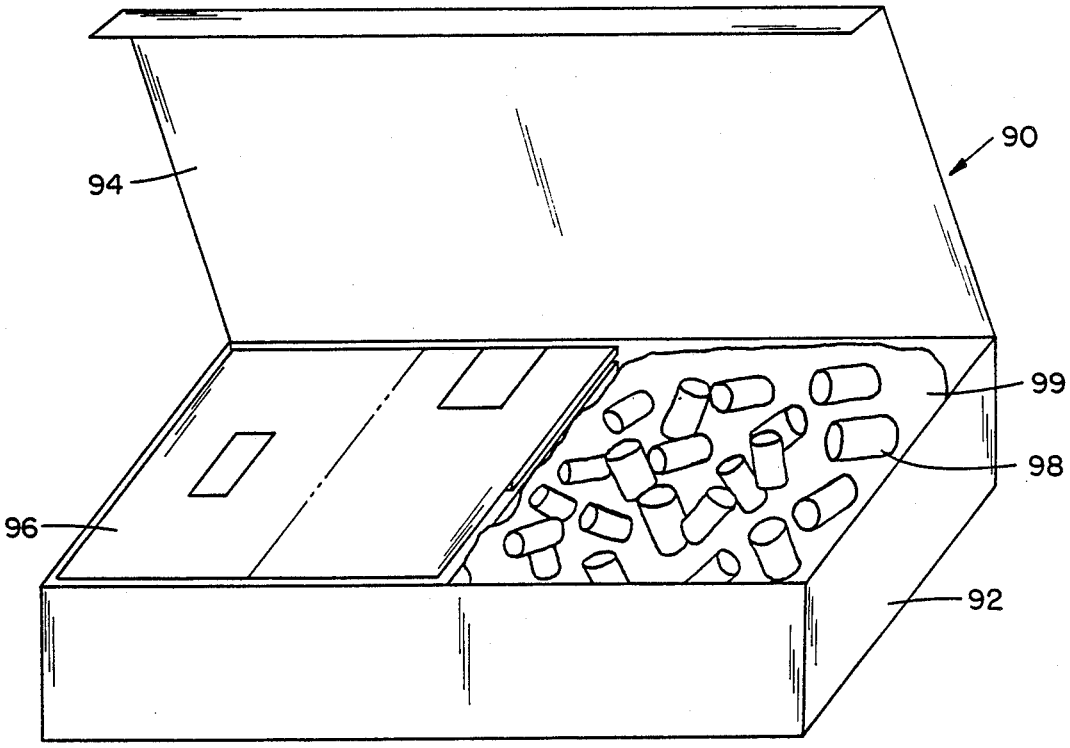
FIG. 10 illustrates the kit of the present invention containing display devices of the present invention joined together in sheets and packages of candy.
Figure 11:
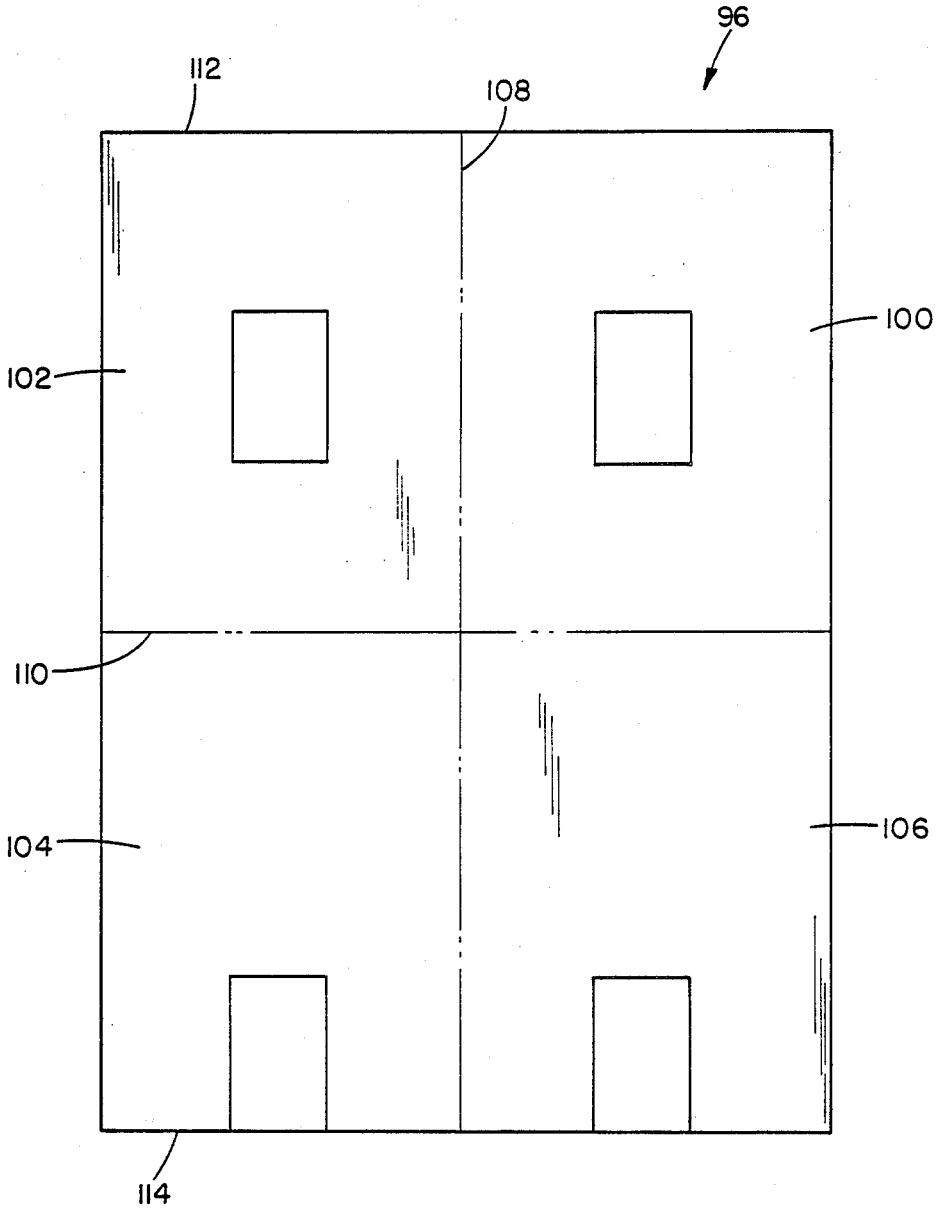
FIG. 11 illustrates the joined display devices of the kit of FIG. 10.

FIG. 10 illustrates the greeting card kit of the present invention. Kit 90 provides a set of greeting cards and packaged novelty items such as rolled candy. Kit 90 preferably is packaged according to a particular theme, whereby the greeting cards contained within kit 90 are printed with messages or drawings in furtherance of the theme. The theme generally may be in celebration of a holiday, birthday or the like. Kit 90 comprises a box, package, or similar container, such as box 92 having cover 94. Provided inside kit 90 is a plurality of greeting card type display devices, which are joined together and packaged as sheets 96. The cards or devices making up sheets 96 are the devices as illustrated in FIGS. 1–9 and comprise all embodiments thereof. As best seen in FIG. 11, sheets 96 comprise a plurality of display devices 100, 102, 104 and 106 joined together at separation lines 108 and 110. While FIG. 10 illustrates only two devices joined together, any number may be joined depending on the packaging requirements as determined by the dimensions of box 92. Preferably, four devices are joined together along separation lines as shown in FIG. 11 at 108 and 110. During manufacture, a sheet of cardboard material is cut to form the number of devices desired for packaging in kit 90. Separation lines 108 and 110 are cut, as well as fold lines similar to the fold lines described above in relation to FIGS. 1–9 and windows 14, 14*a* and 44. The sheet is then folded at fold lines 112 and 114 and the back layers are formed and secured to the front layer, again as described above regarding FIGS. 1–9. The sheets 96 are then printed and packaged with kit 90.

Kit 90 also includes a plurality of packages 98 such as rolled candy or the like, which may be contained in kit 90 individually in a loose arrangement, or in a bag or container 99 as shown in FIG. 10. The number of packages 98 in bag 99 is identical to the number of card display devices 96 provided in the kit. The packages are inserted into the windows as described above in relation to FIGS. 1–9.

While the invention has been particularly shown and described with reference to the preferred embodiments, it will be understood by those skilled in the art that various modifications and changes in form and detail may be made therein without departing from the scope and spirit of the invention. Accordingly, modifications such as those suggested above, but not limited thereto, are to be considered within the scope of the invention.

What is claimed is:

1. A kit comprising a box containing a predetermined number of collapsible display devices and a predetermined number of candy packages, said predetermined number of candy packages being substantially equal to the number of display devices, said display devices being joined together along separation lines within said box to form sheets of display devices, said display devices having a two-layer construction where a front layer and a back layer are constructed from a single sheet of fibrous material folded along a first fold line to form said two layers, said front layer having a window area cut out from said fibrous material shaped to support a candy package fit into said window, said back layer having a series of fold lines parallel to said first fold line and to each other, wherein said back layer is secured to said front layer at least one point and being movable relative to said front layer to move said back layer from a collapsed position to an assembled position when said back layer is folded along said series of fold lines to form a support element having wall members as defined by said series of fold lines, such that said support element allows said device to stand freely.

2. A kit according to claim 1, wherein said separation lines are perforations or tear lines to disengage one device from a group of devices.

3. A kit according to claim 1, wherein said fibrous material comprises cardboard.

4. A kit according to claim 1, wherein said candy packages are enclosed in a single container and separable upon removal of said container.

5. A kit according to claim 1, wherein said devices are joined together in groups of four devices along said separation lines.

* * * * *